US006427139B1

(12) United States Patent
Pierce

(10) Patent No.: US 6,427,139 B1
(45) **Date of Patent: *Jul. 30, 2002**

(54) METHOD FOR REQUESTING AND REFUNDING POSTAGE UTILIZING AN INDICIUM PRINTED ON A MAILPIECE

(75) Inventor: Perry A. Pierce, Darien, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/476,145

(22) Filed: Dec. 30, 1999

(51) Int. Cl.[7] ..... G07B 17/00

(52) U.S. Cl. ..... 705/60; 101/71; 283/71; 705/62; 705/401; 705/408; 705/410

(58) Field of Search ..... 705/60, 61, 62, 705/401, 402, 405, 408, 410; 101/71; 283/71

(56) References Cited

U.S. PATENT DOCUMENTS 4,649,266 A * 3/1987 Eckert ..... 235/432
5,490,077 A * 2/1996 Freytag ..... 705/405
5,726,894 A * 3/1998 Sansone ..... 705/408
5,742,683 A * 4/1998 Lee et al. ..... 705/60
5,768,132 A * 6/1998 Cordery et al. ..... 705/410
5,812,400 A * 9/1998 Eddy et al. ..... 705/410
5,978,781 A * 11/1999 Sansone ..... 705/408
6,058,384 A * 5/2000 Pierce et al. ..... 705/50

FOREIGN PATENT DOCUMENTS

EP 0833280 A2 * 4/1998

OTHER PUBLICATIONS

"Hong Kong Bank Introduces Smarter Subway Cards. (Dah Sing Bank (Hong Kong) introduces service enabling railway smart card users to automatically add value to cards via bank accounts)"; Financial NetNews; Oct. 04, 1999. vol. IV, No. 40, p. 6.*

* cited by examiner

*Primary Examiner*—Edward R. Cosimano
(74) *Attorney, Agent, or Firm*—Steven J. Shapiro; Angelo N. Chaclas

(57) ABSTRACT

A method for requesting a postage refund includes the steps of generating a postage indicium having a postage value and first data indicative that a refund of the postage value is requested; and printing the postage indicium on a mailpiece.

10 Claims, 3 Drawing Sheets

METHOD FOR REQUESTING AND REFUNDING POSTAGE UTILIZING AN INDICIUM PRINTED ON A MAILPIECE

FIELD OF THE INVENTION

The invention disclosed herein relates generally to metering systems and more particularly to the refunding of value in prepaid metering systems.

BACKGROUND OF THE INVENTION

Postage meters are conventional devices that are used to print an indication of paid postage value on a mailpiece. The indication of paid postage value is typically in the form of a postage indicium and may include, in addition to the postage value, a date and/or time the postage indicium was printed, a meter serial number, a mailed from zip code, and cryptographically secure data that can be used by the postal authority to verify the authenticity of the postage indicium.

Included in the postage meter is a vault which accounts for the value of postage received and dispensed by the postage meter. The vault typically includes a descending register, an ascending register and a control sum register. The descending register reflects the amount of funds currently available for dispensing, while the ascending register reflects the total amount of funds dispensed by the postage meter over time. The control sum register is the sum of the ascending and descending registers.

Currently, when a postage meter is to be taken out of service, a meter manufacturer service representative retrieves the postage meter from the customer and contacts a postage refill data center. The service representative provides the data center with a special request code for authorization to zero the postage meter's registers. The data center returns a special code to the service representative which is entered into the postage meter together with an amount of "$0.00" to indicate to the postage meter that a special register clear operation is to be performed. The postage meter then resets the registers of the postage meter to 0. The amount of funds in the descending register prior to its zeroing out is then refunded to the licensed postage meter user.

The above procedure may encounter problems since it relies on the customer service representative to be accurate in reading the postage meter registers and putting that information correctly into a computer or on a piece of paper for manual processing.

In the PERSONAL POST™ postage meter product produced by Pitney Bowes Inc., an improvement was made to the existing refund process. A customer who no longer desires the postage meter or is getting a new postage meter places a call to the data center. The data center, knowing that the postage meter is in a pending withdrawal status, sends a command to the postage meter requesting that a debit be made to the postage meter for an amount equal to that of the current descending register value. The postage meter, upon receipt of the command, debits for the appropriate amount and generates the digital tokens (used for indicium verification) that would have been printed on the mailpiece if the deducted amount was assumed to be dispensed postage. The digital tokens and other information that would have been printed on the mailpiece are electronically sent to the data center for verification in order to ensure that the postage meter properly deducted the appropriate amount of funds. The postal authority is then notified by the data center of the amount to be refunded to the customer and a check is drawn by the postal service and sent to the customer for such refund amount. This refund method requires data center communication with the postage meter and the postal service to ensure a proper refund is given. In this system, if any system links are down, then delays in the processing of the customer refund may occur.

A common problem in all of the refund methods described above is that they require communication with the postage meter vendor infrastructure (data center) to trigger the appropriate refund to the customer. What is needed is a refund process that eliminates the requirement for specialized refund communications with the vendor and allows the postal service, who is in control of the customer's postage account funds, to directly deal with its customer.

SUMMARY OF THE INVENTION

The present invention overcomes the problems discussed above in connection with conventional postage metering refund systems by providing a method for requesting a postage refund including the steps of generating a postage indicium having a postage value and first data indicative that a refund of the postage value is requested; and printing the postage indicium on a mailpiece.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

Figure 1:
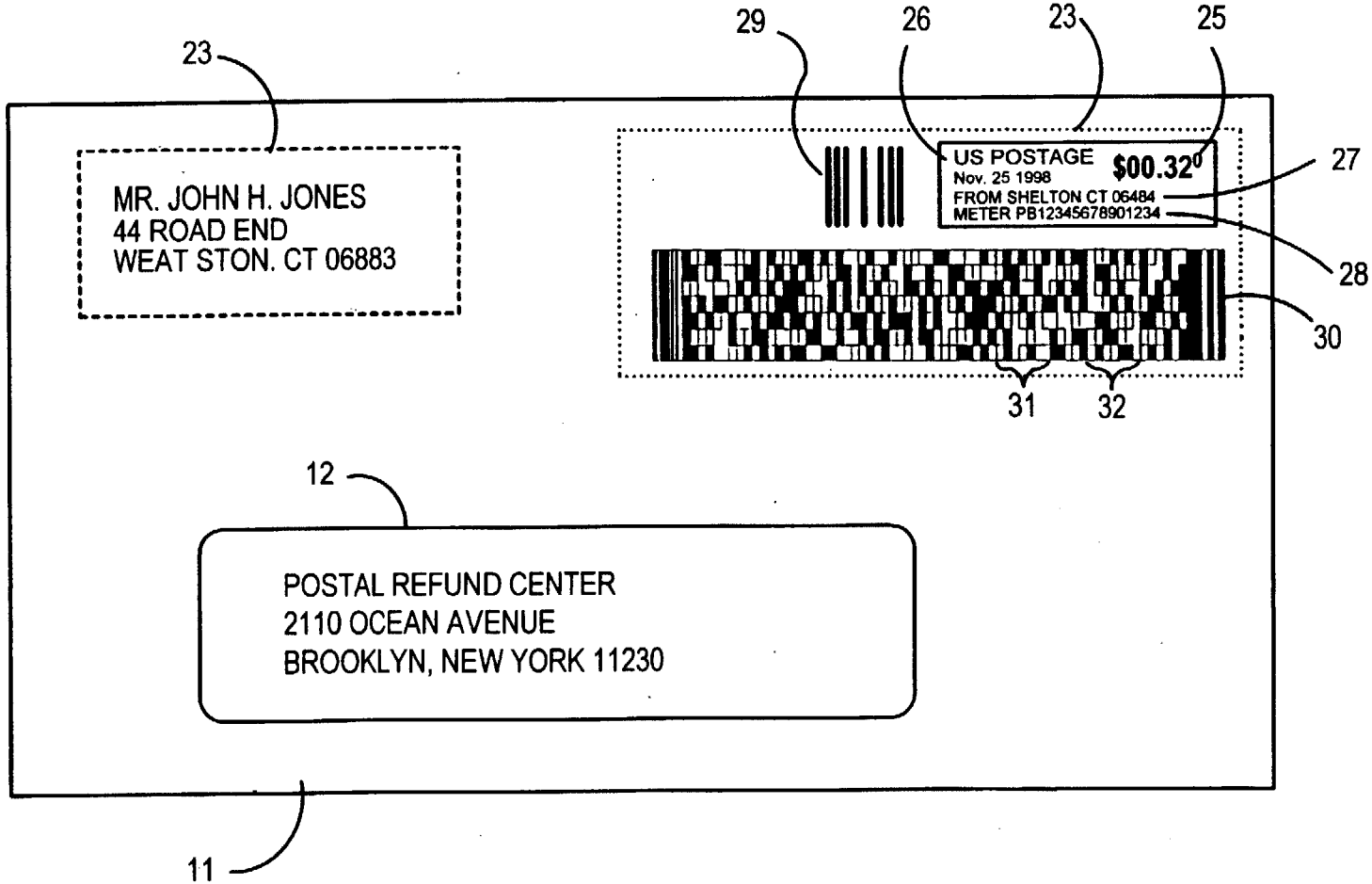
FIG. 1 is a drawing of a mailpiece. incorporating the instant invention.

FIG. 1 is a drawing of a mail piece 11 that includes a recipient address field 12, a sender address field 13 and an Information-Based Indicium (IBI) 23. Required minimum contents and format of IBI 23 are set forth in a specification published by the United States Postal Service and entitled "Information-Based Indicia Program (IBIP) Performance Criteria for Information Based Indicia and Security Architecture for Open IBI Postage Evidencing Systems", dated Jun. 25, 1999, and which is hereby incorporated by reference.

The postage indicium 23 contains a dollar amount of the postage dispensed 25, the date 26 that the postage indicium 23 was affixed to mail piece 11, the place 27 that mail piece 11 was mailed, the postage meter serial number 28, a Facer Identification Mark 29, and a 2D encrypted barcode 30. The barcode 30 includes various data elements as set forth in the aforementioned specification as well as a digital signature. That is, the barcode 30 includes the various data elements in a non-cryptographically secure format. These data elements are used by the postage meter to create a one way hash which is then encrypted using a private key and a known cryptographic algorithm that are each stored within the postage meter. The encrypted hash is the digital signature. Accordingly, when a mailpiece arrives at the postal authority, the barcode 30 is scanned to extract the non-cryptographically secure data elements and the digital signature. The postal authority uses the public key paired to the specific meter's private key to obtain the one-way hash. Then, the postal authority uses the non-cryptographically secure data elements extracted from the barcode 30 and generates its own one-way hash. If the generated hash and the hash included in the barcode 30 match, a verification as to the authenticity of the postage indicium 23 has successfully occurred.

The instant invention takes advantage of the verifiable postage indicium 23 by including a new data element in the barcode 30. The new data element designates the postage indicium 23 as a special "postage refund indicium" and can be a special data element field within barcode 30 or can occupy one of the preexisting data element fields. For ease of explanation, the postage refund data element is shown as part of the barcode 30 at 31. Accordingly, when the postage indicium 23 having the postage refund element 31 contained therein is scanned at the postal authority, it is flagged for special refund processing as will be described in more detail below.

Figure 2:
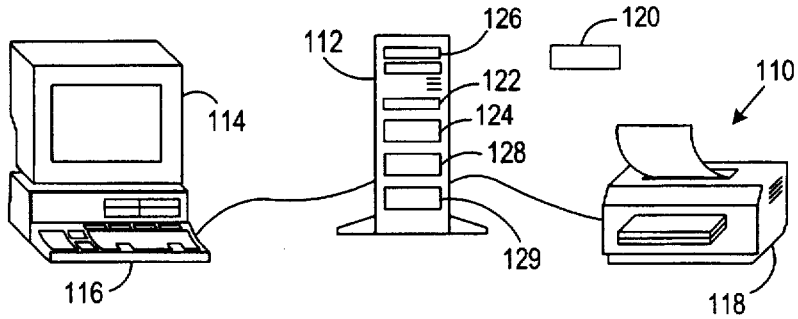
FIG. 2 is a drawing showing the invention incorporated in a personal computer metering system.

FIG. 2 shows a PC meter system incorporating the claimed invention and generally referred to at 110. PC meter system 110 includes a conventional personal computer configured to operate as a host to a removable metering device or electronic vault 120 in which postage funds are stored. PC meter system 110 uses the personal computer 112 and an associated printer 118 to print postage indicium 23 on envelopes at the same time it prints a recipient's address or to print labels for use on pre-addressed return envelopes. It is understood that although the preferred embodiment is described with respect to a postage metering system, the present invention is applicable to any metering system where a refund for prepaid value may be required.

As used herein, the term personal computer is used generally and refers to present and future microprocessing systems with at least one processor operatively coupled to user interface means such as a display and keyboard, and storage media. The personal computer may be a workstation that is accessible by more than one user. Before describing the details of the instant invention, a brief description of the PC metering system 110 is provided.

PC metering system 110 includes a personal computer 112, a display 114, a keyboard 116, and a non-secured digital printer 118, preferably a laser or ink jet printer. PC 112 includes a conventional processor 122, hard drive 124, floppy drives 126 and memory 128. Electronic vault 20, which is housed in a removable card such as a conventional PCMCIA card or a smart card, is a secure encryption device which accomplishes the functions of postage funds management, generation of cryptographically secure data for the postage indicium 23, and traditional accounting functions. PC metering system 110 may also include an optional modem 129 (or other communication devices such as a network card) that can be used for communicating with a postal service or a third party vendor for the recharging of the postage vault with postage funds in a known manner.

The basic operation of a PC metering system is set forth in greater detail in U.S. Pat. No. 5,742,683 which issued Apr. 21, 1998 and which is incorporated herein by reference. For the purposes of understanding the instant invention no further detailed discussion of the basic operation of the PC metering system is considered needed with respect to the generation of the postage indicium. It is sufficient to understand that the personal computer 112 has stored in memory 128 an application program which allows the personal computer user to request that an envelope with a specified postage amount and a recipient address be generated. The personal computer then establishes communication with the vault 120 which is programmed to account for the postage to be dispensed and to provide the personal computer with the digital signature and at least some of the other data elements to be included in the printed barcode 30. The personal computer 112 then generates the final postage indicium image 23 and drives the printer 118 to print the postage indicium image on the mailpiece.

Figure 3:
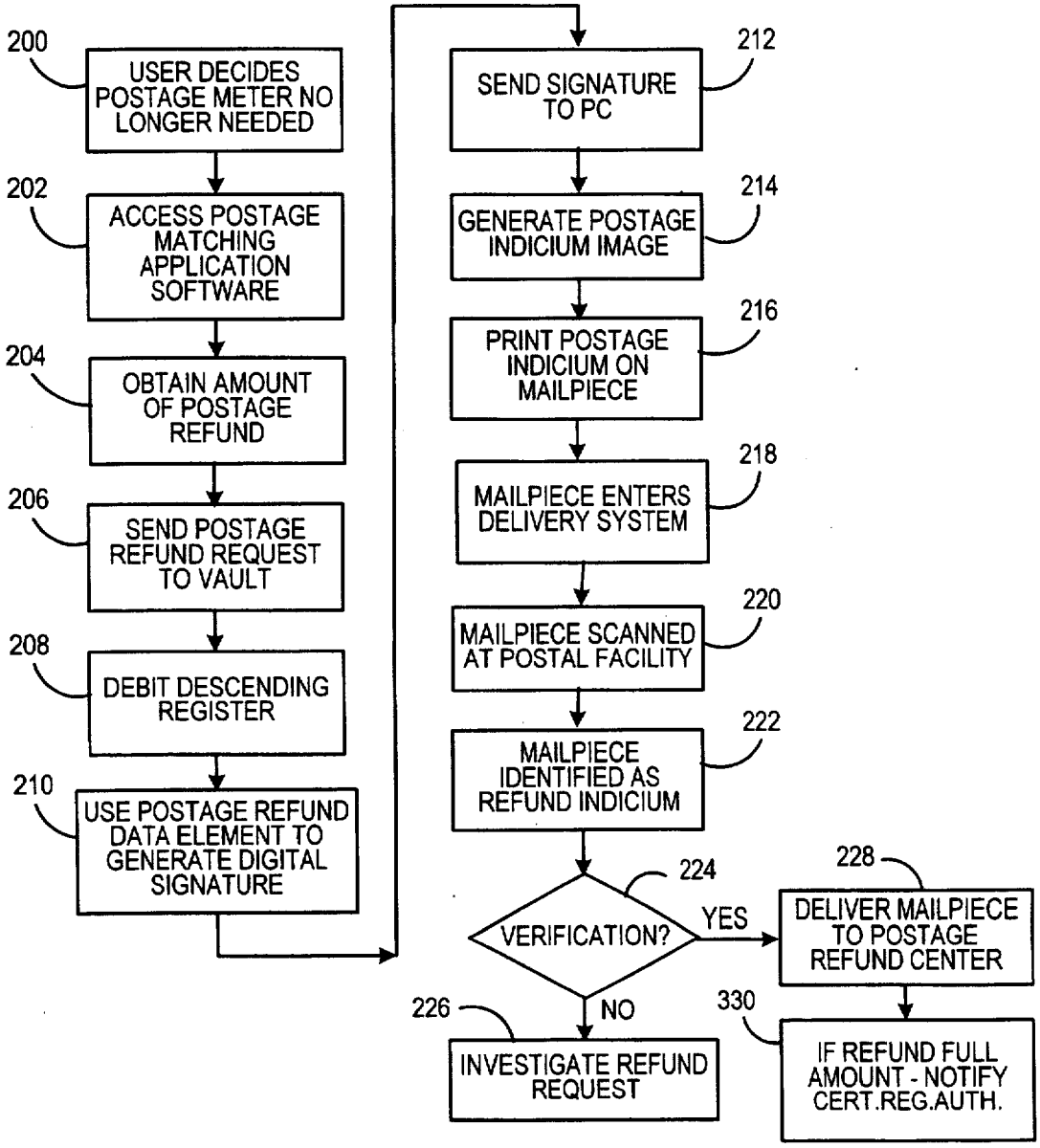
FIG. 3 is a flowchart showing the inventive method for refunding postage.

A detailed explanation of the inventive postage refund process will now be described with reference to FIGS. 2 and 3. At step 200, a licensed postage meter user decides that they no longer want to use the postage metering system 110. Accordingly, the user accesses the postage metering application software resident in memory 128 of personal computer 112 for the purpose of preparing a mailpiece with a postage indicium 23 (step 202). The user will have the option of selecting via the keyboard 116 to designate the particular postage indicium 23 as a postage refund indicium. The application software in one embodiment can then prompt the user to input the amount of the postage to be refunded while in another embodiment the application software will assume that all of the remaining postage in the descending register should be refunded (step 204). In either case, the personal computer then communicates with the vault 120 identifying the postage refund request (step 206). Vault 120 then debits the descending register by the refund amount (step 208) and generates the digital signature in the same manner as when postage is dispensed except that the postage refund data element 31 is also used in generating the digital signature (step 210). The digital signature is then sent to personal computer 12 (step 212) where it is used by the postage application program to be included as part of the postage indicium image 23 (step 214) to be printed on the mail piece 11 (step 216). In its printed form, the postage indicium 23 differs from a postage indicium that was printed as evidence of postage dispensed in that it includes the postage refund data element 31 in barcode 30. In a preferred embodiment the mail piece 11 would be a postcard having a recipient address 12 specifying a postal refund center designated to handle the refunding of postage to postage meter licensees. In one embodiment, the data element could be the delivery point zip code for the delivery address 12.

Once the mailpiece 11 enters the mail delivery stream (step 218), the indicium 23 can be scanned at any postal facility for verification purposes (step 220). During the verification process, the scanning and associated reader will read the postage refund data element 31 and will recognize this indicium 23 as a request for a postage refund (step 222). Verification of the postage indicium 23 is then performed and either the verification is successful or not successful (step 224). In the event the verification is not successful, the postal authority can then communicate with the postage meter licensee in another manner to resolve whether a legitimate refund was actually requested (step 226). On the other hand, if verification is successful, the mailpiece 11 can be diverted to the postal refund center for processing of the refund to the licensee (step 228). Finally, at step 330, if the refund given is for the full amount remaining in the meter (as is the case where a meter is being taken out of service) such that the descending register value in the indicium after the deducted refund is $0.00, the meter serial number is added to a Certificate Revocation List (CRL) that is maintained by the Postal verification system. The CRL identifies those meters whose issued certificates, for use in cryptographically securing an indicium, are no longer valid.

Figure 4:
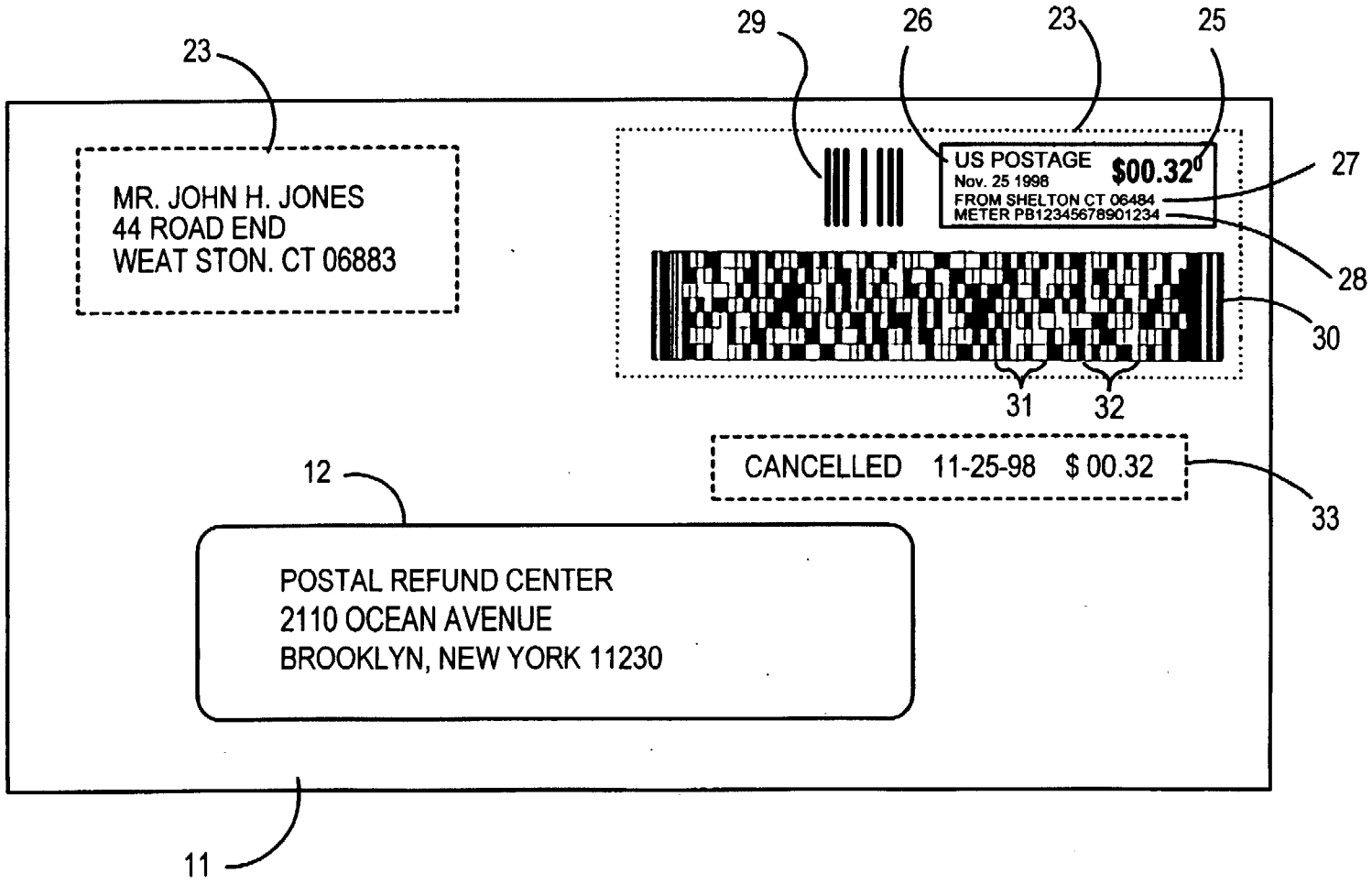
FIG. 4 is a drawing showing the mailpiece of FIG. 1 with a cancellation mark.

In an alternative embodiment, once the verification of the postage refund indicium 23 has been successfully completed, the postal service (at the point of verification in lieu of the refund center) can automatically initiate a refund to the licensee and return the mailpiece 11 to the originator with a cancellation mark 33 (shown in FIG. 4 in dashed lines) thereon that serves as proof of receipt of the refund request by the postal service. The cancellation mark 33 can be crytpographically secure in any conventional manner.

One advantage of sending all postage refund indicium 23 to a postage refund center is that not all mailpieces 11 have to be scanned and verified in the mail delivery stream. That is, for indicium verification purposes it may be sufficient to perform verification on a random sampling basis. In this situation however, at least all postage refund request indicium 23 could be verified at the refund center. Moreover, by including a special refund center address 12 on the refund mailpiece 11 even if the printed postage indicium is not readable by the scanner, an investigation can be undertaken to determine if an attempt at a legitimate refund request was made by the licensee when the mailpiece is sent to the refund center. Also, a repository of refund indicium can be maintained at the refund center as physical evidence for the purpose of resolving disputes.

In addition to the above, the barcode 30 can further include an additional data element 32 which allows the user to not only identify that a refund is requested but the mechanism as to how the refund should be paid. For example, different data elements 32 could be used to designate that the refund should be paid by check, credited to a credit card, electronically transferred to an account, or provided as a credit to the licensee's postage account. Naturally, instead of a separate data element 32, different refund data elements 31 could be used with each one automatically being associated with a different refund mechanism.

In yet another embodiment, the postage meter user can be required to contact a data center when a postage refund request is to be printed on a mailpiece. Preferably this communication is accomplished electronically between the postage meter and the data center as part of the refund process. During this communication information about the refund indicium (or an electronic image thereof) can be sent to the data center for storage. Thus, in the event that the mailpiece 11 having the refund indicium 23 thereon gets lost in the mail delivery stream, the data center will have data to verify that a legitimate refund request was made. Alternatively, instead of communicating with the data center, the postage meter can store a record of all postage refund indicium which could also serve as proof that a refund indicium was printed.

While the above embodiments relate to a PC meter, the instant invention can be implemented in any open or closed metering system. Additionally, while the refund data element is shown as being included as part of barcode 30, it could be a separate element on the mailpiece set forth in a known location to be associated with the postage indicium. Moreover, as a separate element it can be in a cryptographically or non-cryptographically secure form. Finally, while the preferred embodiment shows the postage indicium as an IBI, it could be any type of currently proposed or known type of postage indicium.

While the present invention has been disclosed and described with reference to a single embodiment thereof, it will be apparent, as noted above that variations and modifications may be made therein. It is thus intended in the following claims to cover each variation and modification that falls within the true spirit and scope of the present invention. For example, while the instant invention is shown in a postage metering system it could be applied to any type of transaction evidencing device in which cryptographically secure data is used to verify the authenticity of an item.

What is claimed is:

1. A method for requesting a postage refund comprising the steps of:

generating a postage indicium including a postage value and first data indicative that a refund of the postage value is requested; and printing the postage indicium on a mailpiece.

2. A method as recited in claim 1, further comprising addressing the mailpiece to a postage refund center.

3. A method as recited in claim 1 further comprising entering the mailpiece into a mail delivery stream for processing of the refund of the postage value.

4. A method as recited in claim 1, further comprising including in the postage indicium second data indicative of the payment method to be used in providing the postage refund.

5. A method as recited in claim 4, wherein the payment method is one of payment by check, credit to a credit card, electronic funds transfer to an account, and credit to a postage account.

6. A method for refunding postage comprising the steps of:

receiving, a mailpiece having a postage indicium including a postage value and first data indicative that a refund of the postage value is requested;

reading the postage indicium to obtain the first data and the postage value; and refunding the postage value based on the reading of the postage indicium.

7. A method as recited in claim 6, wherein at least a portion of the postage indicium on the mailpiece is cryptographically secure and further comprising verifying the authenticity of the mailpiece based on the cryptographically secure portion of the postage indicium.

8. A method as recited in claim 7, wherein the mailpiece further includes a sender address and further comprising after verifying the authenticity of the mailpiece placing a cancellation mark on the mailpiece and returning the mailpiece with the cancellation mark to the sender address as proof that the request for refund of the postage value was received.

9. A method as recited in claim 8, further comprising cryptographically securing the cancellation mark.

10. A method as recited in claim 9 further comprising refunding the postage amount using a payment method identified from data in the postage indicium.

* * * * *